US006183110B1

(12) United States Patent
Chang

(10) Patent No.: US 6,183,110 B1
(45) Date of Patent: Feb. 6, 2001

(54) U-SHAPED TROUGH FRAME FOR HANGING CHRISTMAS LIGHT BULB SERIES

(76) Inventor: Ching Hsi Chang, No. 10, Don Mei Industrial Park, Shih Chou Cheng, Tai San City, Kaun Don (CN)

( * ) Notice: Under 35 U.S.C. 154(b), the term of this patent shall be extended for 0 days.

(21) Appl. No.: 09/246,941

(22) Filed: Feb. 9, 1999

(51) Int. Cl.[7] ..... F21S 3/14
(52) U.S. Cl. ..... 362/249; 362/804; 362/252
(58) Field of Search ..... 362/249, 252, 362/804

(56) References Cited

U.S. PATENT DOCUMENTS 5,317,491 * 5/1994 Lee ..... 362/249
5,526,246 * 6/1996 Liou ..... 362/252
6,017,134 * 1/2000 Wang ..... 362/252
6,019,494 * 2/2000 Iee ..... 362/807
6,030,096 * 2/2000 Lin ..... 362/249

* cited by examiner

*Primary Examiner*—Sandra O'Shea
*Assistant Examiner*—Anabel M. Ton
(74) *Attorney, Agent, or Firm*—Rosenberg, Klein & Lee

(57) ABSTRACT

This invention discloses a U-shaped trough frame used for hanging Christmas light bulb series. The U-shaped trough frame is provided with a plurality of partition plates that divide the U-shaped trough frame into several segments. In each segment there are two support plates that define a channel therebetween. The channel allows a light bulb holder of Christmas light bulb series to extend through.

4 Claims, 4 Drawing Sheets

U-SHAPED TROUGH FRAME FOR HANGING CHRISTMAS LIGHT BULB SERIES

BACKGROUND OF THE INVENTION

The invention relates to a U-shaped trough frame structure used for hanging Christmas light bulb series.

Conventional frames of Christmas light bulb series generally consist of a frame body and holding means. The frame body provides space for accommodating Christmas light bulbs while the holding means secure Christmas light bulbs. However, conventional frames expose light bulbs to the atmosphere. Therefore, the light bulb series are easy to get wet, leading to short circuit. In case that the holding means are loosened or off their positions, the light bulb series will be easy to move, resulting in a deformed pattern.

The object of the invention is to provide a U-shaped trough frame for hanging Christmas light bulb series, which frame has all-shaped trough to house Christmas light bulbs and to secure them therein.

To achieve the foregoing object, the invention provides a U-shaped trough frame that has a plurality of partition plates formed on the bottom of the U-shaped trough and extended upwards. These partition plates divide the frame into several segments in accordance with the length of a Christmas light bulb series. In each segment there are support plates raised from two side walls of the U-shaped trough and defining a channel between the support plates. The channel is sized to allow a light bulb holder of the Christmas light bulb series to extend through.

The frame structure according to the invention is new and useful and provides convenience in use. The U-shaped trough design can effectively house Christmas light bulbs and secure them therein. If the frame is made of transparent materials, it can obtain a decorative effect either on the front side or on the rear side.

BRIEF DESCRIPTION OF ACCOMPANYING DRAWINGS

DETAILED DESCRIPTION OF PREFERRED EMBODIMENTS

Figure 1:
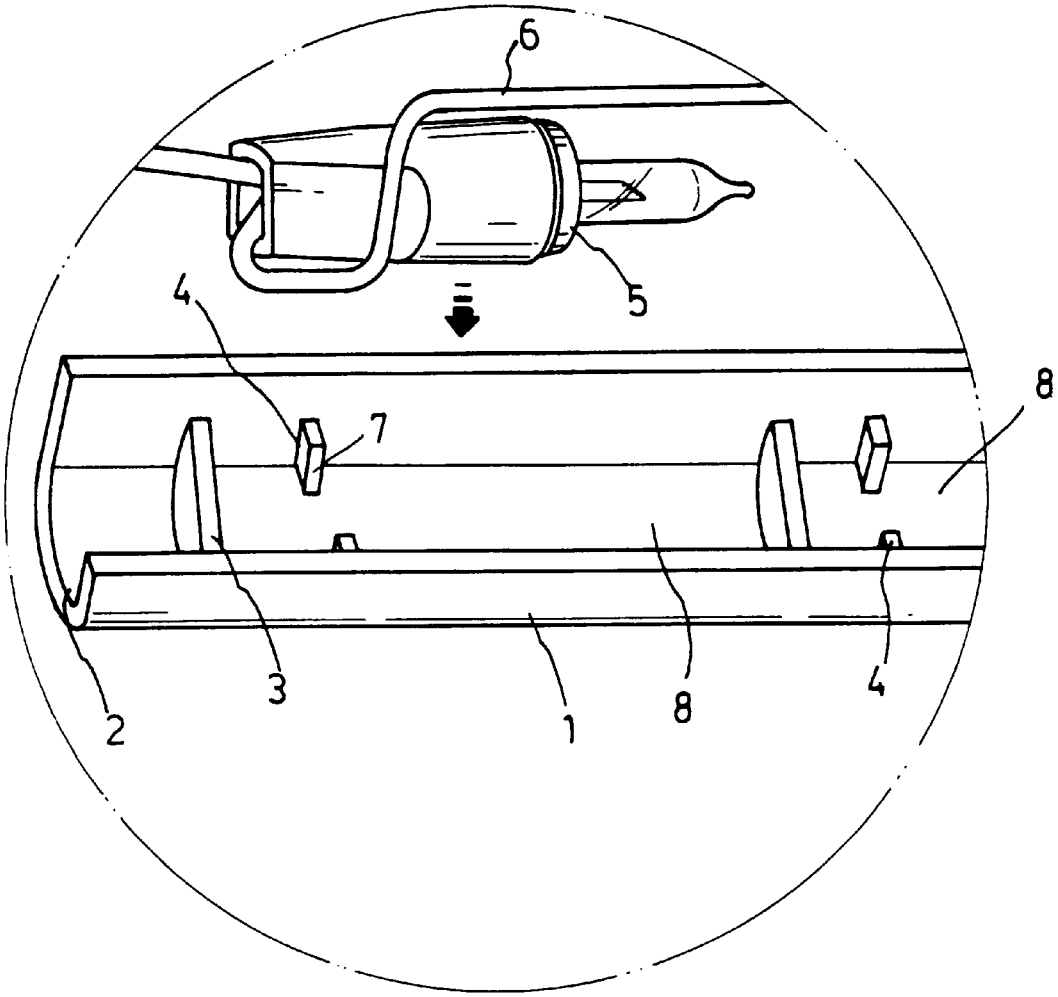
FIG. 1 is a perspective view partially depicting the U-shaped trough frame structure according to the invention.
Figure 2:
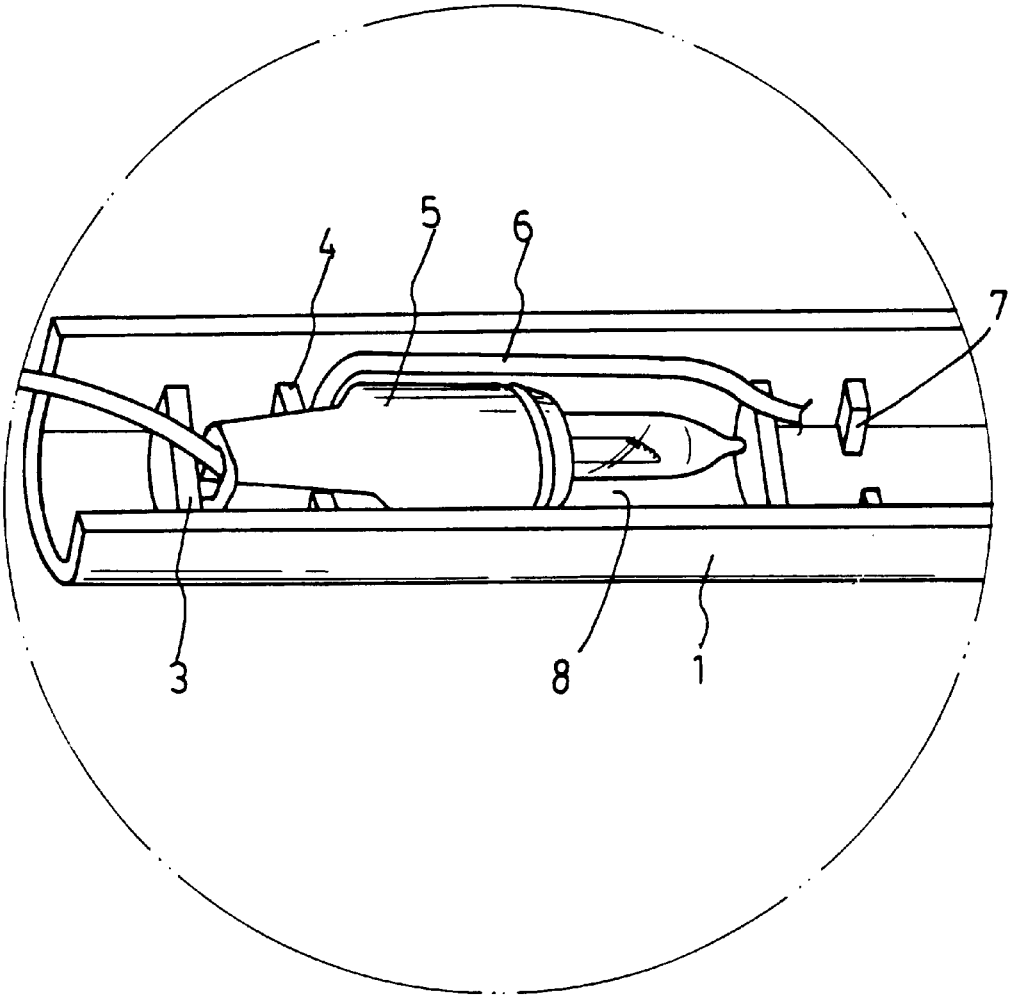
FIG. 2 is another perspective view illustrating the combination of a miniature light bulb with the frame of FIG. 1.
Figure 3:
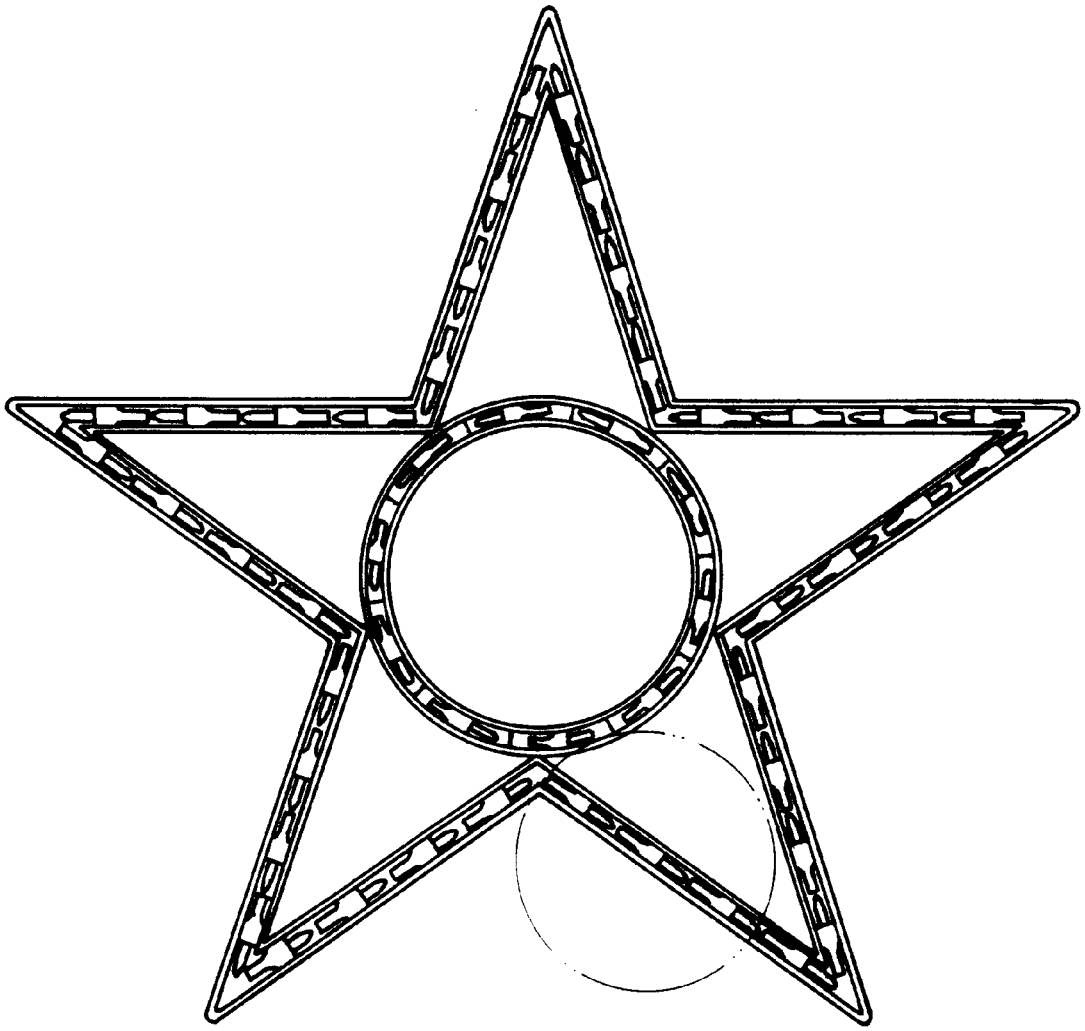
FIG. 3 is a plan view schematically showing the whole structure of the U-shaped trough frame of FIG. 1.
Figure 4:
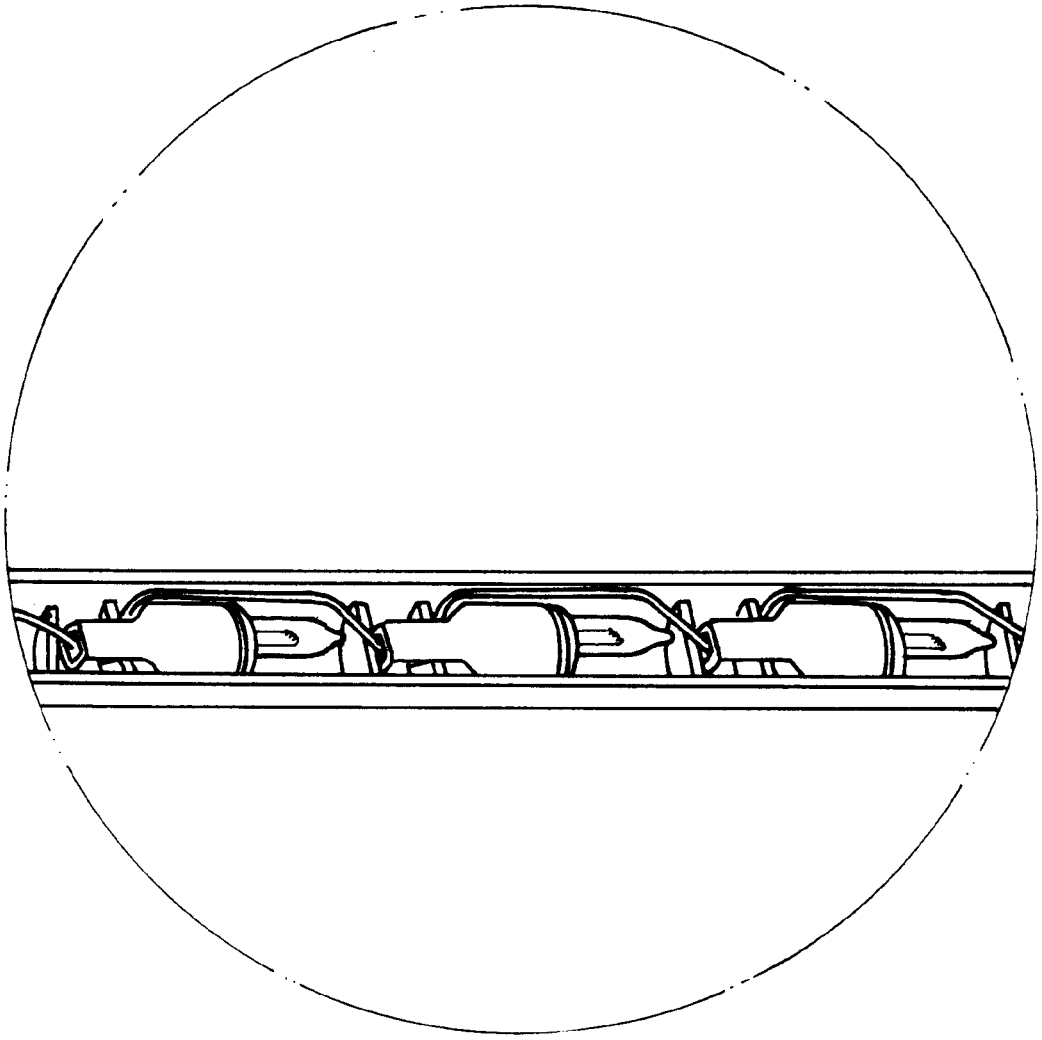
FIG. 4 is an enlarged view indicating a portion of the frame structure of FIG. 3.

As shown in the accompanying drawings, a U-shaped trough frame 1 comprises a plurality of partition plates 3 separately formed on the internal wall surface of the U-shaped trough. The partition plates 3 extend upwards from the bottom of the U-shaped trough 2 to a height slightly lower than the side wall height. The partition plates 3 are disposed along the longitudinal direction of the frame to divide the frame into several segments 8. In each segment 8 there are two support plates 4 arranged near the partition plate 3. The support plates 4 define a channel 7 therebetween, which is dimensioned to allow the lower portion of a Christmas light bulb holder 5 to extend through. The conductive wire 6 of the light bulb holder 5 extends over the partition plate 3 to an adjacent segment 8. In this way all light bulb holder 5 of the Christmas light bulb series are integrated.

What is claimed is:

1. A light bulb mounting system for positioning and holding a light bulb holder connected to light bulb comprising:

a continuously longitudinally extending U-shaped frame having a base wall and a pair of opposing sidewalls, said U-shaped frame defining a trough;

at least a pair of longitudinally displaced partition plates fixedly secured within said trough, said partition plates being displaced each from the other by a dimension substantially equal to a length equal to an extended length of said light bulb and said light bulb holder for capturing said combined light bulb holder and said light bulb therebetween, said pair of partition plates defining a light bulb mounting segment, said U-shaped frame extending continuously throughout said segment; and, at least a pair of transversely displaced support plates fixedly secured to said trough within said light bulb mounting segment defining a channel for insert of said light bulb holder.

2. The light bulb mounting system as recited in claim 1 where said partition plates extend in an upward direction from said base wall of said U-shaped frame to a height less than the height of said U-shaped frame sidewalls.

3. The light bulb mounting system as recited in claim 1 including a plurality of pairs of partition plates defining a plurality of light bulb mounting segments.

4. The light bulb mounting system as recited in claim 1 where said pair of transversely displaced support plates are displaced by a distance substantially equal to a transverse dimension of a neck portion of said light bulb holder whereby said light bulb holder is mounted within said channel.

* * * * *